US009528403B2

(12) United States Patent
Kwun et al.

(10) Patent No.: US 9,528,403 B2
(45) **Date of Patent: *Dec. 27, 2016**

(54) LUBRICATION DEVICE OF HIGH PRESSURE PUMP FOR COMMON RAIL SYSTEM

(71) Applicant: Hyundai Motor Company, Seoul (KR)

(72) Inventors: Sun Dong Kwun, Suwon-si (KR); Sung Il You, Gwacheon-si (KR); Chang Sun Hwang, Incheon (KR)

(73) Assignee: Hyundai Motor Company, Seoul (KR)

( * ) Notice: Subject to any disclaimer, the term of this patent is extended or adjusted under 35 U.S.C. 154(b) by 209 days.

This patent is subject to a terminal disclaimer.

(21) Appl. No.: 14/060,935

(22) Filed: Oct. 23, 2013

(65) Prior Publication Data

US 2014/0299093 A1 Oct. 9, 2014

(30) Foreign Application Priority Data

Apr. 5, 2013 (KR) ..... 10-2013-0037220

(51) Int. Cl.
*F01M 9/00* (2006.01)
*F01M 1/02* (2006.01)
*F01M 9/04* (2006.01)

(52) U.S. Cl.
CPC ..... *F01M 9/00* (2013.01); *F01M 1/02* (2013.01); *F01M 9/04* (2013.01)

(58) Field of Classification Search
CPC ..... F01M 9/00; F01M 9/04; F01M 9/10; F01M 9/104; F02M 59/102; F02M 2200/02; F04B 53/18
USPC ..... 123/90.35, 90.48
See application file for complete search history.

(56) References Cited

U.S. PATENT DOCUMENTS 3,314,303 A * 4/1967 Maat ..... F01L 1/14 123/90.5
3,490,423 A * 1/1970 Haverdink et al. ..... 123/90.16
4,708,102 A * 11/1987 Schmid ..... 123/90.35
4,915,592 A * 4/1990 Hishinuma et al. ..... 417/206
5,127,374 A * 7/1992 Morel, Jr. ..... F01L 1/14 123/90.35
5,566,652 A * 10/1996 Deppe ..... 123/90.35
5,775,203 A * 7/1998 Osborn et al. ..... 92/128
6,129,518 A * 10/2000 Ricco ..... 417/206
(Continued)

FOREIGN PATENT DOCUMENTS

DE 102010030498 A1 * 12/2011 ..... F02M 59/44
JP 58-62111 U 4/1983
(Continued)

OTHER PUBLICATIONS

JP2010223130 English Translation.pdf.*

*Primary Examiner* — Minh Truong
(74) *Attorney, Agent, or Firm* — Morgan, Lewis & Bockius LLP

(57) ABSTRACT

A lubrication device of a high pressure pump for a common rail system, may include a first lubrication channel fluid-connecting a shaft chamber formed in a pump housing of the high pressure pump, and a low pressure pump, and a support lubrication channel formed through a shoe such that one end thereof is fluid-connected to the first lubrication channel and the other end thereof is fluid-connected to a friction portion where a roller and the shoe contact each other.

11 Claims, 5 Drawing Sheets

(56) References Cited

U.S. PATENT DOCUMENTS

| | | | | |
|---|---|---|---|---|
| 6,217,299 | B1 * | 4/2001 | Jay | F02M 59/102 123/495 |
| 6,328,009 | B1 * | 12/2001 | Brothers | F01L 1/14 123/90.35 |
| 6,460,499 | B1 * | 10/2002 | Mason et al. | 123/90.55 |
| 6,769,413 | B2 * | 8/2004 | Ishimoto | 123/509 |
| 7,748,359 | B2 * | 7/2010 | Bartley et al. | 123/90.48 |
| 8,826,874 | B2 * | 9/2014 | Hattiangadi | F01L 1/146 123/90.5 |
| 9,074,474 | B2 * | 7/2015 | Maier et al. | |
| 9,091,255 | B2 * | 7/2015 | Yoshimura | |
| 2009/0126661 | A1 * | 5/2009 | Bang | 123/90.16 |
| 2011/0052427 | A1 * | 3/2011 | Shaull et al. | 417/364 |
| 2013/0133621 | A1 * | 5/2013 | Jones et al. | 123/456 |
| 2014/0165957 | A1 * | 6/2014 | Kwun et al. | 123/196 R |
| 2015/0004012 | A1 * | 1/2015 | Kwun et al. | 417/228 |

FOREIGN PATENT DOCUMENTS

| | | | |
|---|---|---|---|
| JP | 5-141216 | A | 6/1993 |
| JP | 5-180116 | A | 7/1993 |
| JP | 2004-270647 | A | 9/2004 |
| JP | 2008-286124 | A | 11/2008 |
| JP | 2010-223130 | A | 10/2010 |
| KR | 2003-0077337 | A | 10/2003 |
| KR | 10-2005-0051372 | A | 6/2005 |

* cited by examiner

LUBRICATION DEVICE OF HIGH PRESSURE PUMP FOR COMMON RAIL SYSTEM

CROSS-REFERENCE TO RELATED APPLICATION

The present application claims priority to Korean Patent Application No. 10-2013-0037220 filed on Apr. 5, 2013, the entire contents of which is incorporated herein for all purposes by this reference.

BACKGROUND OF THE INVENTION

Field of the Invention

The present disclosure relates to a lubrication device of a high pressure pump for a common rail system, and more particularly, to a lubrication device of a high pressure pump for a common rail system, enabling to improve lubrication performance of a friction portion where a roller and a shoe is in contact with each other.

Description of Related Art

Generally, a high pressure pump 10 used in a common rail system includes a pump housing 11, a roller 12, a shoe 13 and a plunger 14, as shown in FIGS. 1 and 2. In the pump housing 11, a shaft chamber 11*a*, a roller chamber 11*b* and a spring chamber 11*c* are formed to be connected each other.

A cam shaft 21 provided with a cam 21*a* is arranged rotatably in the shaft chamber 11*a*, the roller 12 and the shoe 13 are arranged to contact the cam 21*a* in the roller chamber 11*b*, and a spring 16 is arranged through a spring seat 15 in the spring chamber 11*c*.

One end of the plunger 14 is arranged to be in contact with the shoe 13 and the other end of the plunger 14 is arranged to be disposed on a fuel compression chamber 17 placed between an inlet valve 22 and an outlet valve 23.

The inlet valve 22 is arranged through a fuel channel connected to a low pressure pump 24 and the outlet valve 23 is arranged through a fuel channel connected to a common rail 25.

Accordingly, when the cam shaft 21 rotates by the driving of an engine, the roller 12 rotates in accordance with lift of a cam profile to push the shoe 13 such that the plunger 14 reciprocates with the shoe 13 being pushed wherein fuel at a low pressure, which is supplied to the fuel compression chamber 17 through the inlet valve 22 by the movement of the plunger 14, is compressed and flowed out to the common rail 25 through the outlet valve 23.

Meanwhile, the roller 12 and the shoe 13 are arranged to be in contact each other with strong pressure wherein when a friction portion M1 is not lubricated sufficiently, where the roller 12 and the shoe 13 contact each other, it is to be worn seriously with friction, and be sand-burnt in severe cases. In general, the friction portion M1 of the roller 12 and the shoe 13 is lubricated using fuel of a low pressure pump 24 to prevent the wearing and sand-burning.

That is, according to a related art, the friction portion M1 of the roller 12 and the shoe 13 is lubricated using a first lubrication channel 31 connecting the low pressure pump 24 and the shaft chamber 11*a* of the pump housing 11, and a second lubrication channel 32 connecting the shaft chamber 11*a* and the spring chamber 11*c* wherein the fuel of the low pressure pump 24 fills in the shaft chamber 11*a* and then in the spring chamber 11*c*, and also the friction portion M1 of the roller 12 and the shoe 13 is applied with the fuel to be lubricated.

However, according to the related art as configured above, a channel through which lubrication fuel moves to the friction portion M1 of the roller 12 and the shoe 13 is long and thus the cam shaft 21 drives before lubricating sufficiently the friction portion M1 of the roller 12 and the shoe 13. In this case, the friction portion M1 of the roller 12 and the shoe 13, to which strong compression load applies, is to be worn seriously and further sand-burnt due to friction, thereby causing a poor high pressure pump 10.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a lubrication device of a high pressure pump for a common rail system, enabling to lubricate sufficiently the friction portion within a short time period by shortening the path through which the lubrication fuel moves to the friction portion where the roller and the shoe contact each other, thereby improving the lubrication of the friction portion of the roller and the shoe to prevent wearing of the roller and the shoe and increase performance of the high pressure pump.

In an aspect of the present invention, a lubrication device of a high pressure pump for a common rail system, may include a first lubrication channel fluid-connecting a shaft chamber formed in a pump housing of the high pressure pump, and a low pressure pump, and a support lubrication channel formed through a shoe such that one end thereof is fluid-connected to the first lubrication channel and the other end thereof is fluid-connected to a friction portion where a roller and the shoe contact each other.

The lubrication device of the high pressure pump for the common rail system may further include a check valve disposed through the support lubrication channel, for allowing for fuel to move to the support lubrication channel from the first lubrication channel and for preventing the fuel from being moved reversely to the first lubrication channel from the support lubrication channel.

The support lubrication channel may include a first support channel that is branched off from the first lubrication channel and is extended to the inside of the shoe, and a second support channel that is fluid-connected to the first support channel and open to the friction portion.

The first support channel is selectively fluid-connected to the first lubrication chamber in accordance with rotation of a cam formed to a cam shaft rotatably mounted in the shaft chamber.

The check valve is arranged through at a place of the first support channel, which is fluid-connected to the first lubrication channel.

A plurality of second support channels is provided to supply simultaneously a large amount of fuel to the friction portion.

The first lubrication channel is fluid-connected to a spring chamber formed in the pump housing, wherein the shoe moves selectively in the spring chamber.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
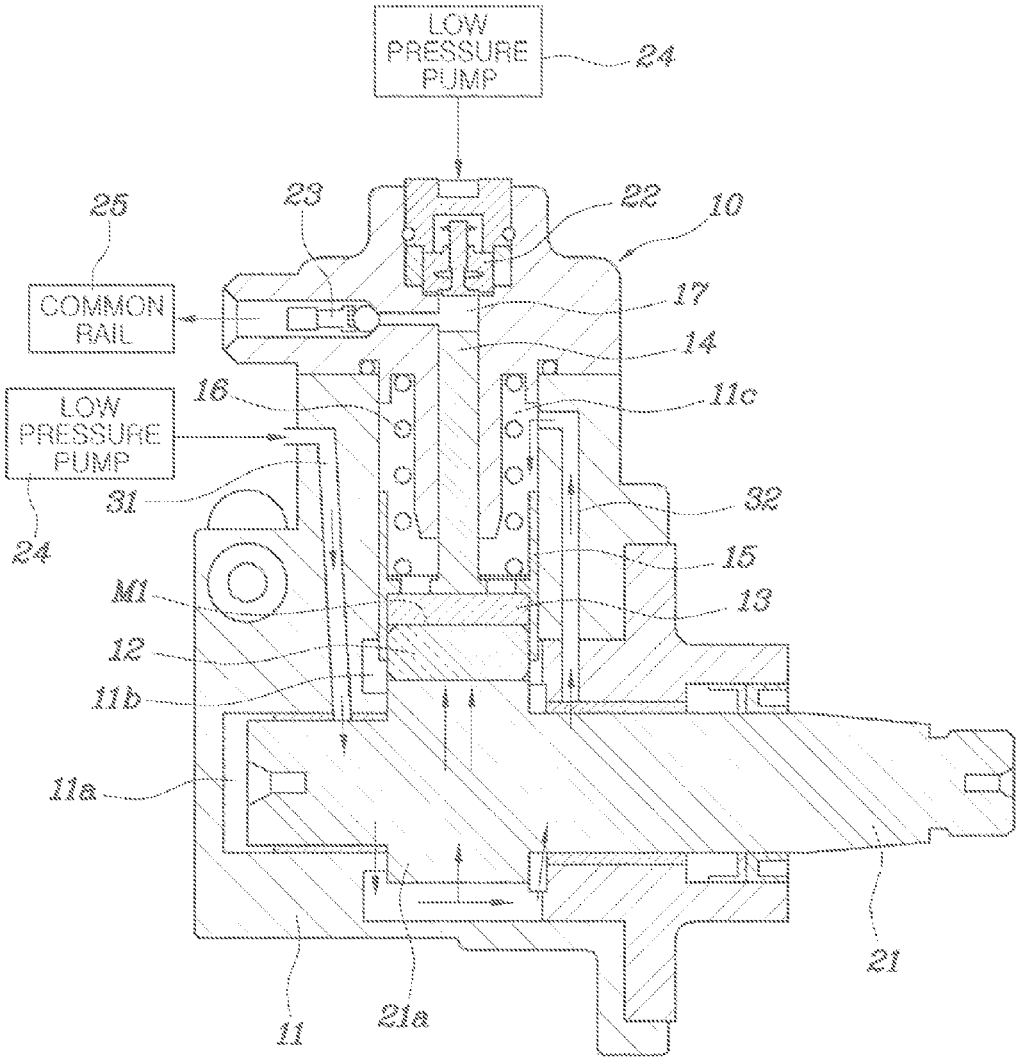
FIG. 1 (Related Art)
FIGS. 1 and 2 are views showing a lubrication device of a high pressure pump for a common rail system according to a related art, respectively.
Figure 2:
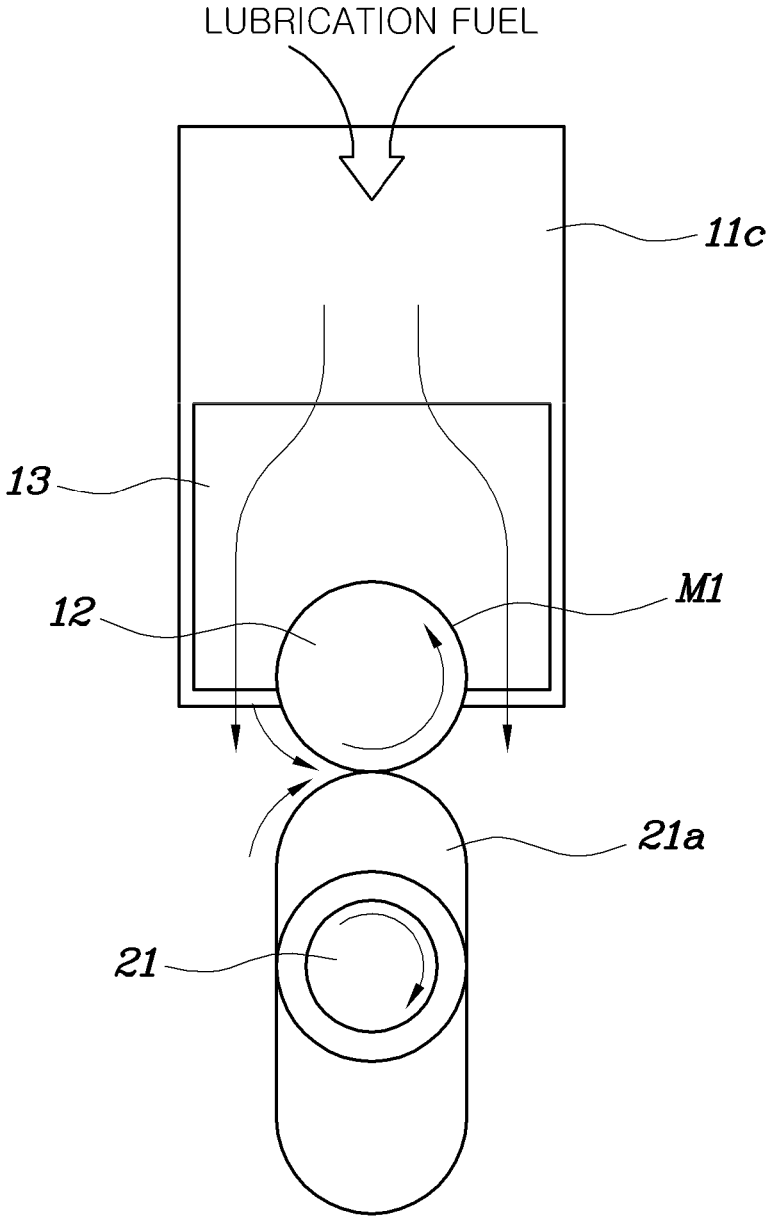
FIG. 2 (Related Art)

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a lubrication device of a high pressure pump for a common rail system will be described, referring to the accompanying drawings, same reference numerals are given to the same components as a conventional lubrication device of a high pressure for a common rail system.

Figure 3:
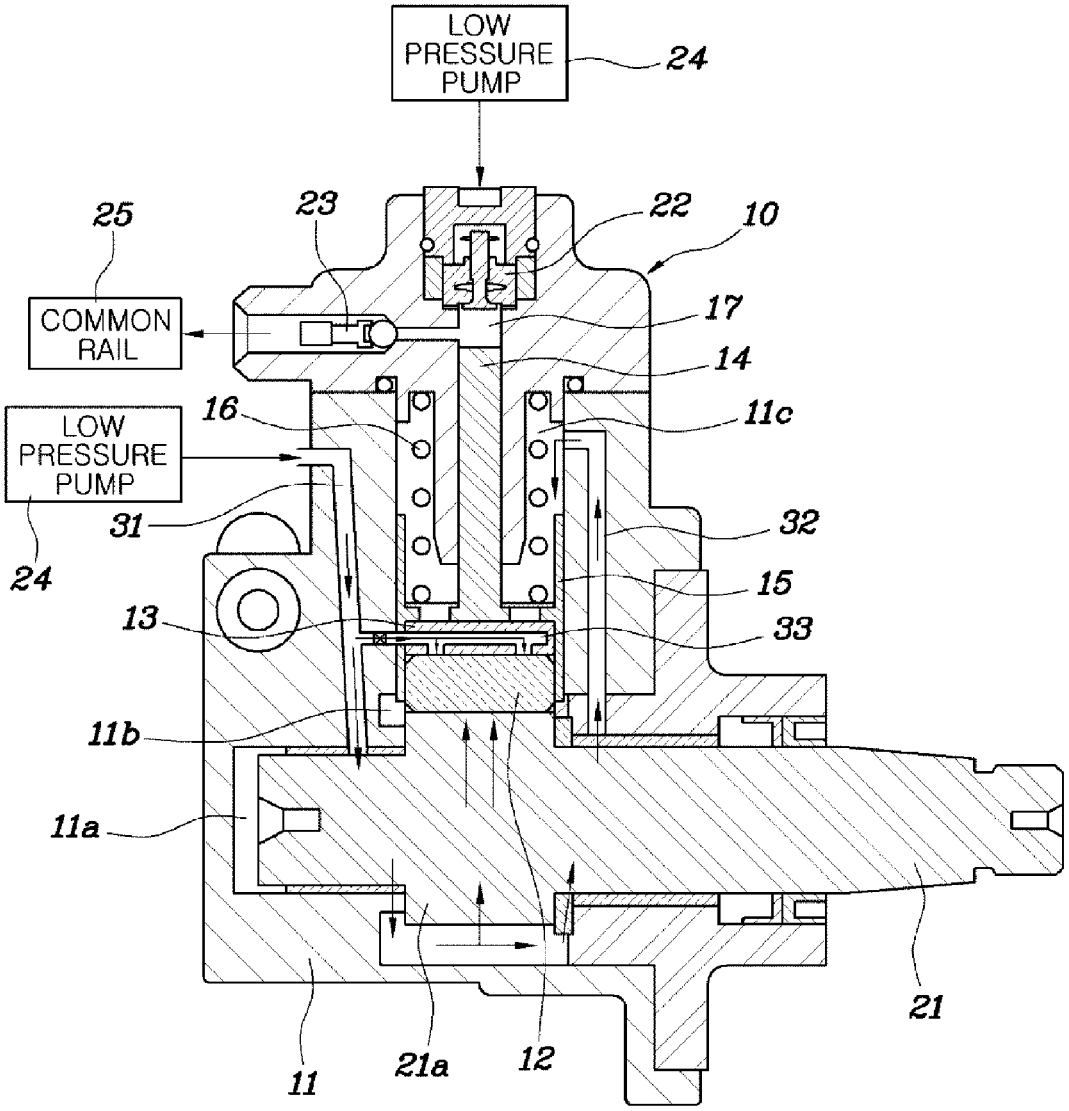
FIGS. 3 to 5 are views showing a lubrication device of a high pressure pump for a common rail system according to an exemplary embodiment of the present invention.
Figure 4:
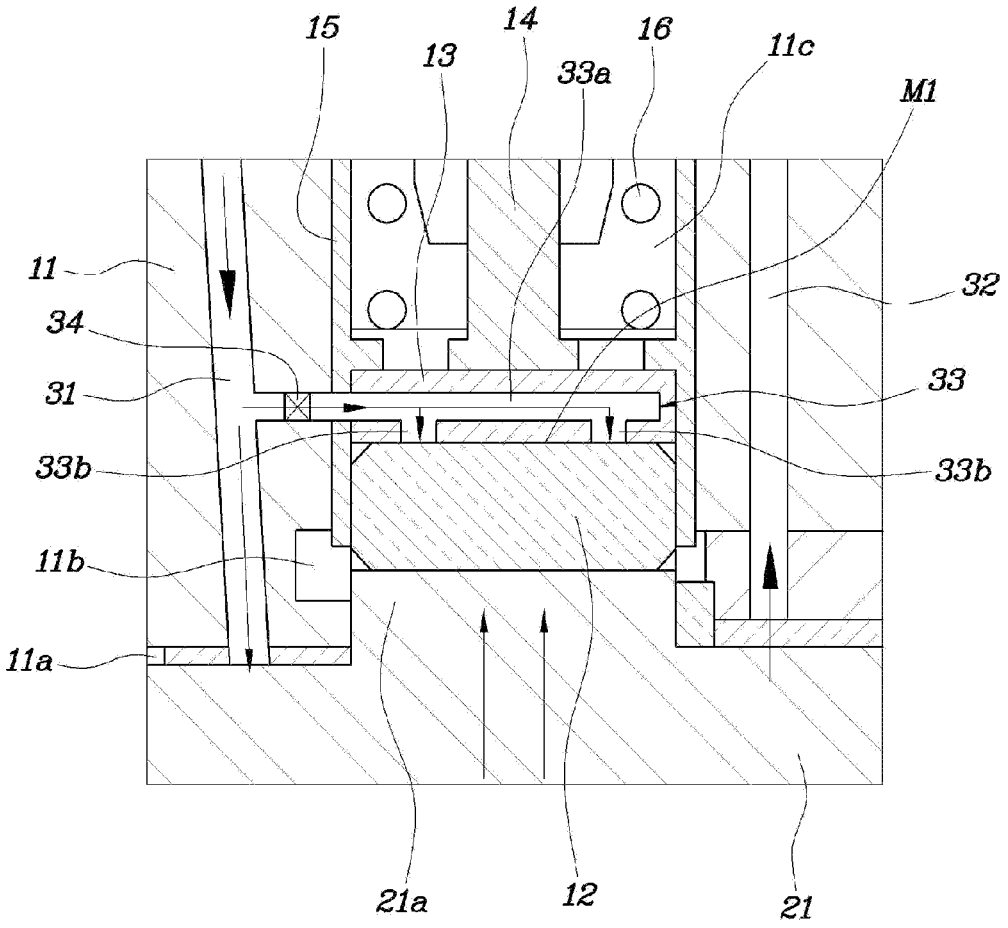
Figure 5:
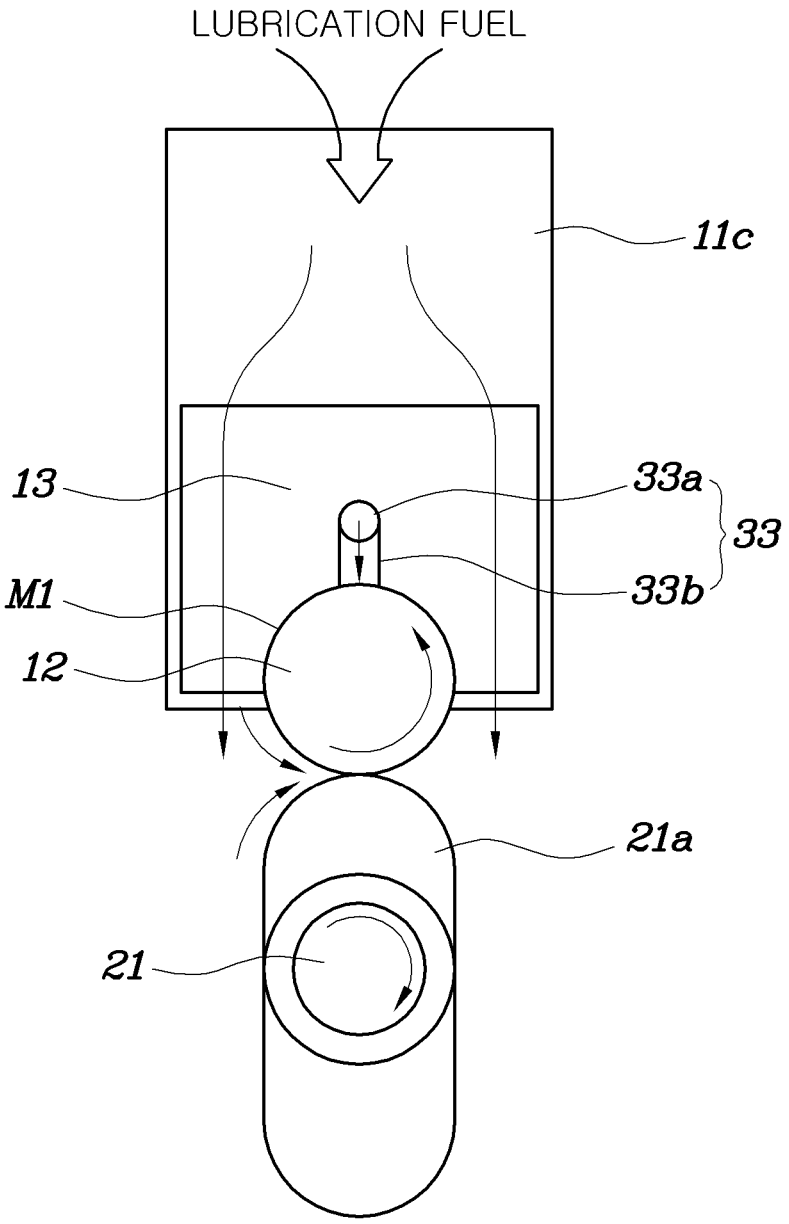

A high pressure pump 10 for a common rail system according to an exemplary embodiment of the present invention, as shown in FIGS. 3 to 5, includes a pump housing 11, a roller 12, a shoe 13 and a plunger 14 wherein a shaft chamber 11*a*, a roller chamber 11*b* and a spring chamber 11*c* are formed to be connected each other in the pump housing 11.

A cam shaft 21 provided with a cam 21*a* is arranged rotatably in the shaft chamber 11*a*, the roller 12 and the shoe 13 are arranged to contact the cam 21*a* in the roller chamber 11*b*, and a spring 16 is arranged through a spring seat 15 in the spring chamber 11*c*.

One end of the plunger 14 is arranged to be in contact with the shoe 13 and the other end of the plunger 14 is arranged to be disposed on a fuel compression chamber 17 placed between an one-way inlet valve 22 and an one-way outlet valve 23.

The inlet valve 22 is arranged through a fuel channel connected to a low pressure pump 24 and the outlet valve 23 is arranged through a fuel channel connected to a common rail 25.

Accordingly, when the cam shaft 21 rotates by the driving of an engine, the roller 12 rotates in accordance with lift of a cam profile to push the shoe 13 such that the plunger 14 reciprocates with the shoe 13 being pushed wherein fuel at a low pressure, which is supplied to the fuel compression chamber 17 through the inlet valve 22 by the movement of the plunger 14, is compressed and flowed out to the common rail 25 trough the outlet valve 23.

Meanwhile, the roller 12 and the shoe 13 are arranged to be in contact each other with strong pressure wherein when a friction portion M1 is not lubricated sufficiently, where the roller 12 and the shoe 13 contact each other, it is to be worn seriously with friction, and be sand-burnt in severe cases. In general, the friction portion M1 of the roller 12 and the shoe 13 is lubricated using fuel of a low pressure pump 24 to prevent the wearing and the sand-burning.

That is, according to an exemplary embodiment of the present invention, the lubrication device of the high pressure pump 10 includes: a first lubrication channel 31 fluid-connecting the low pressure pump 24 and the shaft chamber 11*a* formed in the pump housing 11, a second lubrication channel 32 fluid-connecting the shaft chamber 11*a* and the spring chamber 11*c*, and a support lubrication channel 33 formed through the shoe 13 such that one end thereof is fluid-connected to the first lubrication channel 31 and the other end thereof is fluid-connected to the friction portion M1 where the roller 12 and the shoe 13 contact each other.

That is, the support lubrication channel 33 is branched off from the first lubrication channel 31 and then passes through the pump housing 11, the spring seat 15 and the shoe 13 to be fluid-connected to the friction portion M1 where the roller 12 and the shoe 13 contact each other.

Further, the lubrication device according to an exemplary embodiment of the present invention further includes a check valve 34 disposed through the support lubrication channel 33, allowing for fuel to move to the support lubrication channel 33 from the first lubrication channel 31 and preventing the fuel from being moved reversely to the first lubrication channel 31 from the support lubrication channel 33.

The support lubrication channel 33 includes a first support channel 33*a* that is branched off from the first lubrication channel 31 and then passes through the pump housing 11 and the spring seat 15 to extend to the inside of the shoe 13, and a second support channel 33*b* that is connected to the first support channel 33*a* and open to the friction portion M1.

In an aspect of the present invention, the first lubrication channel 31 may be selectively fluid-connected to the first support channel 33*a* when the shoe 13 moves with the roller 12 in accordance with the rotation of the cam 21*a*.

Meanwhile, only one check valve 34 is arranged through at a place of the first support channel 33*a*, which is connected to the first lubrication channel 31. If the check valve is arranged at every second support channel 33*b*, the number of the check valve increases thereby increasing weight and cost thereof.

Furthermore, a plurality of second support channels 33*b* may be provided to supply simultaneously a large amount of fuel to the friction portion M1, considering a durability of the roller 12.

Under the lubrication device of a high pump for a common rail according to an exemplary embodiment of the present invention, a part of the lubrication fuel which moves to the shaft chamber 11*a* of the pump housing 11 through the first lubrication channel 31 in the low pressure pump 24, is supplied directly to the friction portion M1 of the roller 12 and the shoe 13 through the support lubrication channel 33.

Accordingly, the path of lubrication fuel which is supplied to the friction portion M1 of the roller 12 and the shoe 13 can be shortened greatly, comparing to the conventional lubrication device, and time period for lubricating the friction portion M1 can be reduced remarkably. Further, the cam shaft 21 can drive after lubricating sufficiently the friction portion M1 thereby preventing the wearing of the friction portion M1 to the maximum and improving a durability of the high pressure pump 10.

Furthermore, the lubrication fuel which is supplied to the shaft chamber 11*a* through the first lubrication channel 31 moves to the spring chamber 11*c* through the second lubrication chamber 32 after filling in the shaft chamber 11*a*, and is supplied additionally to the friction portion M1 of the roller 12 and the shoe 13 with rotations of the cam 21*a* and the roller 12, thereby improving greatly lubrication performance of the friction portion M1 of the roller 12 and the shoe 13.

According to the lubrication device of a high pressure pump for a common rail system according to an exemplary embodiment of the present invention, a large amount of lubrication fuel can be supplied to the friction portion from a low pressure pump within a short time period to prevent wearing of the friction portion to the maximum and improve greatly a durability of the high pressure pump.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lubrication device of a high pressure pump for a common rail system, comprising:

a first lubrication channel fluid-connecting a shaft chamber formed in a pump housing of the high pressure pump and a low pressure pump; and a support lubrication channel formed through a shoe such that a first end of the support lubrication channel is fluid-connected to the first lubrication channel and a second end of the support lubrication channel is disposed onto a friction portion where a cylindrical surface of a roller and the shoe contact each other, wherein the support lubrication channel includes:

a first support channel branching off from the first lubrication channel and extending inside of the shoe substantially parallel with a longitudinal direction of the shoe; and a second support channel branching from and fluid-connected to the first support channel and formed in the shoe and extending substantially perpendicularly from the first support channel to be connected to the second end of the support lubrication channel.

2. The lubrication device of the high pressure pump for the common rail system of claim 1, further including:

a check valve disposed in the support lubrication channel, for allowing for fuel to move to the support lubrication channel from the first lubrication channel and for preventing the fuel from being moved reversely to the first lubrication channel from the support lubrication channel.

3. The lubrication device of the high pressure pump for the common rail system of claim 1, wherein the first support channel is selectively fluid-connected to the first lubrication channel in accordance with movement of the shoe in response to rotation of a cam formed to a cam shaft rotatably mounted in the shaft chamber.

4. The lubrication device of the high pressure pump for the common rail system of claim 2, wherein the check valve is arranged in the first support channel, which is fluid-connected to the first lubrication channel.

5. The lubrication device of the high pressure pump for the common rail system of claim 1, wherein a plurality of second support channels is provided to supply simultaneously an amount of fuel to the friction portion.

6. The lubrication device of the high pressure pump for the common rail system of claim 1, wherein the first lubrication channel is fluid-connected to a spring chamber formed in the pump housing, and wherein the shoe moves selectively in the spring chamber.

7. A lubrication device of a high pressure pump for a common rail system, comprising:

a support lubrication channel formed in a shoe and through which a fuel of a low pressure pump flows in order to lubricate a friction portion where a cylindrical surface of a roller and the shoe are in contact with each other by using the fuel of the low pressure pump, wherein the support lubrication channel includes:

a first support channel formed inside of the shoe and including a first end and a second end, wherein the first end of the first support channel is fluid-connected to a first lubrication channel, and the second end of the first support channel is extended inside of the shoe substantially in parallel with a longitudinal direction of the shoe, and wherein, through the first lubrication channel, the fuel of the low pressure pump is supplied to a shaft chamber in which a cam shaft is mounted; and a second support channel branched from and fluid-connected to the first support channel and formed in the shoe and extended substantially perpendicularly from the first support channel to lubricate the friction portion where the cylindrical surface of the roller and the shoe contact each other.

8. The lubrication device of the high pressure pump for the common rail system of claim 7, wherein the first lubrication channel is fluid-connected to a spring chamber formed in a pump housing, and wherein the shoe moves selectively in the spring chamber.

9. The lubrication device of the high pressure pump for the common rail system of claim 7, wherein a check valve is provided on an inlet of the support lubrication channel, which allows the fuel to be flowed to the friction portion from the low pressure pump and prevents the fuel from being flowed to the lower pressure pump from the friction portion.

10. The lubrication device of the high pressure pump for the common rail system of claim 7, wherein the first support channel is selectively fluid-connected to the first lubrication channel in accordance with movement of the shoe in response to rotation of a cam formed to the cam shaft.

11. The lubrication device of the high pressure pump for the common rail system of claim 7, wherein the second support channel is provided as a plural in order to supply simultaneously an amount of fuel to the friction portion.

* * * * *